US008971767B2

(12) United States Patent
Takagami et al.

(10) Patent No.: US 8,971,767 B2
(45) Date of Patent: Mar. 3, 2015

(54) CHARGE APPLYING MEMBER AND IMAGE FORMING APPARATUS WITH THE SAME

(71) Applicant: KYOCERA Document Solutions Inc., Osaka (JP)

(72) Inventors: Ai Takagami, Osaka (JP); Takahiko Murata, Osaka (JP); Yoshimi Shimizu, Osaka (JP); Maki Ike, Osaka (JP); Kanako Morimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/939,724

(22) Filed: Jul. 11, 2013

(65) Prior Publication Data

US 2014/0023397 A1 Jan. 23, 2014

(30) Foreign Application Priority Data

Jul. 19, 2012 (JP) ..... 2012-160684

(51) Int. Cl.
*G03G 15/02* (2006.01)
*G03G 15/16* (2006.01)

(52) U.S. Cl.
CPC ..... *G03G 15/0233* (2013.01); *G03G 15/1685* (2013.01)
USPC ..... 399/176; 399/313

(58) Field of Classification Search
CPC ..... G03G 15/0233; G03G 15/1685; G03G 2215/1614; G03G 2215/1619
USPC ..... 399/176, 313
See application file for complete search history.

(56) References Cited

U.S. PATENT DOCUMENTS

| | | | | |
|---|---|---|---|---|
| 4,871,585 | A | * | 10/1989 | Kano et al. |
| 5,336,960 | A | * | 8/1994 | Shimizu et al. |
| 7,313,338 | B2 | * | 12/2007 | Shimazu et al. |
| 2004/0253025 | A1 | * | 12/2004 | Matsuura |
| 2009/0226214 | A1 | * | 9/2009 | Deguchi |
| 2009/0226215 | A1 | * | 9/2009 | Deguchi |

FOREIGN PATENT DOCUMENTS

| | | | | |
|---|---|---|---|---|
| JP | 05257362 | A | * | 10/1993 |
| JP | 2002-156810 | A | | 5/2002 |
| JP | 2010240974 | A | * | 10/2010 |

* cited by examiner

*Primary Examiner* — David Gray
*Assistant Examiner* — Milton Gonzalez
(74) *Attorney, Agent, or Firm* — Knobbe, Martens, Olson & Bear LLP

(57) ABSTRACT

A charge applying member includes a conductive roller and a shaft. The conductive roller includes a first region in contact with a member to be charged and facing an image forming region of the member to be charged and a second region next to a longitudinal end of the first region and facing a region of the member to be charged outside the image forming region and is configured to apply a charge to the member to be charged. The shaft formed of a metallic material inserted into the conductive roller and configured to be given a voltage from a power supply. A region plated with a metal having a lower ionization tendency than the shaft is formed as a plated region on a surface portion of the shaft corresponding to the first and second regions and a non-plated region is formed on a surface portion of the shaft corresponding to the second region.

11 Claims, 5 Drawing Sheets

CHARGE APPLYING MEMBER AND IMAGE FORMING APPARATUS WITH THE SAME

INCORPORATION BY REFERENCE

This application claims priority to Japanese Patent Application No. 2012-160684 filed on Jul. 19, 2012, the entire contents of which are incorporated by reference herein.

BACKGROUND

The present disclosure relates to a charge applying member configured to apply an electric charge to a member to be charged for use in an image forming apparatus, such as a copier, a printer, a facsimile machine, or a multifunction peripheral having these functions, and an image forming apparatus with the charge applying member.

The image forming apparatus involves previously charging a photoconductor serving as an image carrier to a predetermined potential before forming an electrostatic latent image on the photoconductor. An example of a known charging device capable of charging the surface of the photoconductor is a contact type charging device which includes: a charging member including a conductive roller and a shaft passing through the axis of the conductive roller and having electric conductivity; a pair of bearings journaling both ends of the shaft; and a feeder member making contact with one end of the shaft and capable of applying a voltage to the conductive roller. The conductive roller has an elastic layer formed on the surface thereof and the voltage can be applied to the elastic layer. In the case of using the contact type charging device, the charging member and the photoconductor rotate relative to each other with the charging member held in contact with the photoconductor, so that the charging device applies an electric charge to the photoconductor.

If in this charging device rust forms at sliding interfaces between the shaft and the bearings or a contact site between the shaft and the feeder member, this may cause rotation failure or electric feeding failure, resulting in charging failure. For example, if a paper sheet is heated in order to fix a toner image transferred to the paper sheet and water contained in the paper sheet is evaporated in the charging device by the heating, so that the humidity inside the charging device is increased or if the charging member is exposed to high humidity for long periods, water may penetrate the conductive roller. Conductive rollers are usually made of a special material containing, for example, a highly acidic substance. Water having penetrated the conductive roller may force the highly acidic substance in the conductive roller to ooze out of it and the highly acidic substance may adhere to the surface of the shaft. If a highly acidic substance adheres to the shaft, rust will form on a contact portion of the shaft with the conductive roller, in which case it is difficult to stop the rust from developing from the contact portion with the conductive roller to sliding portions of the shaft with the bearings and a contact site of the shaft with the feeder member.

Relevant techniques for reducing charging failure due to rusting are known. In an example of the known techniques, a charging member includes a conductive roller and a shaft inserted into and through the conductive roller, wherein a rust inhibitor is applied to portions of the shaft facing both ends of the conductive roller. With this structure, even if rust forms on a portion of the shaft in contact with the conductive roller, the rust inhibitor makes the rust less likely to develop to the sliding portions with the bearings and the contact site with the feeder member.

SUMMARY

A technique further improved over the above known technique is herein proposed as one aspect of the present disclosure.

A charge applying member according to one aspect of the present disclosure is configured to apply an electric charge to a member to be charged for use in an image forming apparatus which is configured to develop an electrostatic latent image into a toner image and transfer the toner image to a transfer member. The charge applying member according to the one aspect of the present disclosure includes a conductive roller and a shaft.

The conductive roller includes a first region held in contact with a member to be charged and facing an image forming region of the member to be charged and a second region disposed next to a longitudinal end of the first region and facing a region of the member to be charged located outside the image forming region and is configured to apply an electric charge to the member to be charged.

The shaft is formed of a metallic member inserted into the conductive roller and is configured to be given a voltage from a power supply.

A region plated with a metal having a lower ionization tendency than the shaft is formed as a plated region on a portion of an outer periphery of the shaft corresponding to the first and second regions and a non-plated region is formed on a part of a portion of the outer periphery of the shaft corresponding to the second region.

DETAILED DESCRIPTION

Hereinafter, a description will be given of a charge applying member and an image forming apparatus according to an embodiment as one aspect of the present disclosure with reference to the drawings.

Figure 1:
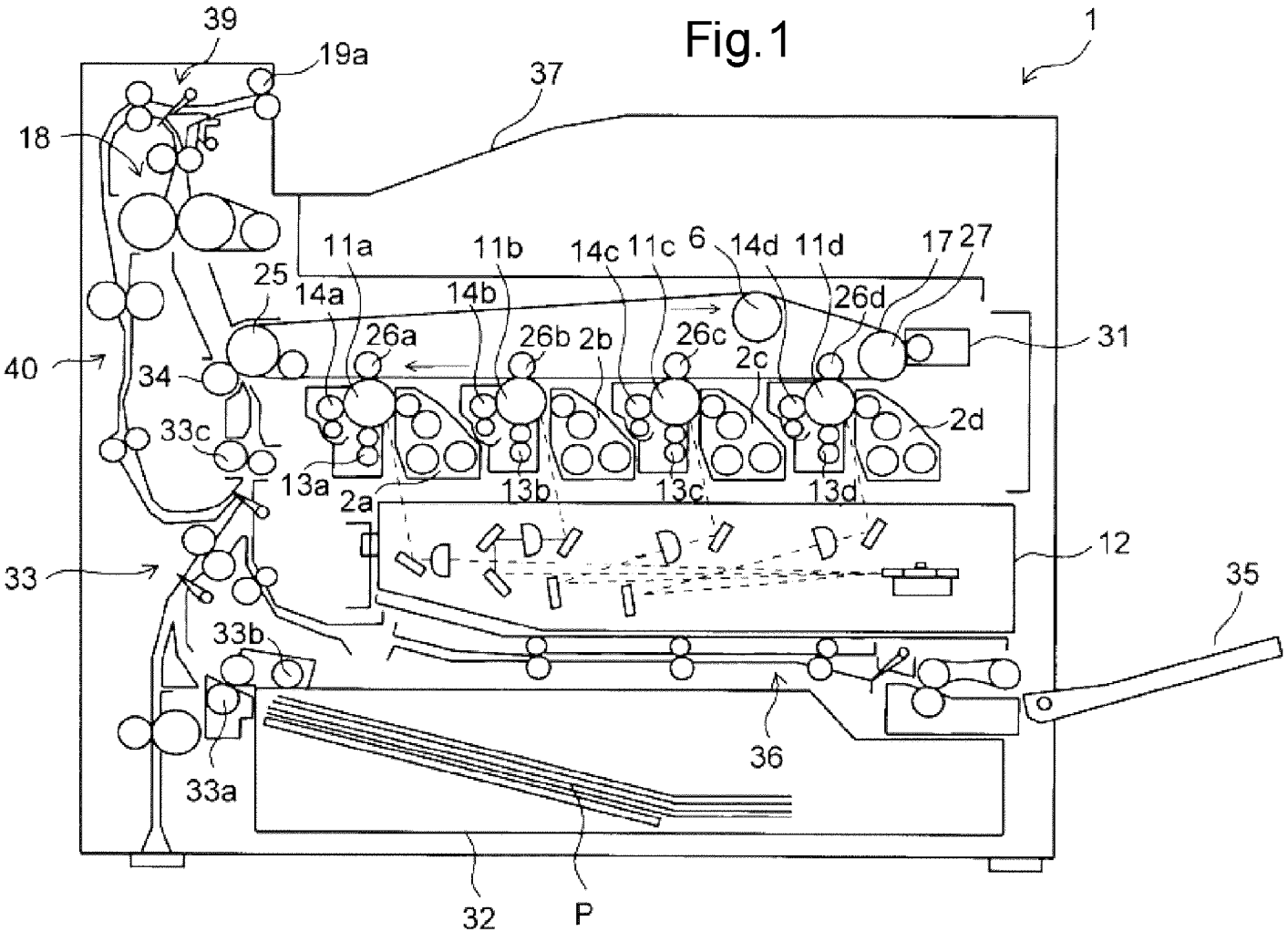
FIG. 1 is a view schematically showing the structure of an image forming apparatus including a charge applying member according to an embodiment as one aspect of the present disclosure.

FIG. 1 is a view schematically showing the structure of an image forming apparatus including a charge applying member according to an embodiment as one aspect of the present disclosure. The image forming apparatus 1 is a tandem color printer, wherein an organic photoconductor photosensitive material (OPC photosensitive material) is used as a photosensitive material forming photosensitive layers of rotatable photoconductors 11*a*, 11*b*, 11*c*, 11*d* and the photoconductors 11*a*, 11*b*, 11*c*, 11*d* are disposed for different colors of magenta, cyan, yellow, and black, respectively. The photoconductors 11*a* to 11*d* may be amorphous silicon photoconductors. Arranged around each photoconductor 11*a* to 11*d* are a developing device 2*a* to 2*d*, an exposure unit 12, a charging device 13*a* to 13*d*, and a cleaning device 14*a* to 14*d*.

The developing devices 2*a* to 2*d* are disposed to the right of and facing the photoconductors 11*a* to 11*d*, respectively, and configured to supply toner to the photoconductors 11*a* to 11*d*, respectively. The charging devices 13*a* to 13*d* are disposed upstream of the developing devices 2*a* to 2*d* in the direction of rotation of the photoconductors 11*a* to 11*d* and facing the surfaces of the photoconductors 11*a* to 11*d*, respectively, and configured to charge the surfaces of the photoconductors 11*a* to 11*d*, respectively.

The exposure unit 12 is disposed below the developing devices 2*a* to 2*d* and configured to scan-expose each photoconductor 11*a* to 11*d* based on image data, including characters and/or pictures, input from a personal computer or the like to an image input section (not shown). The exposure unit 12 includes a laser light source and a polygon mirror and also includes reflecting mirrors and lenses associated with the photoconductors 11*a* to 11*d*. Laser light emitted from the laser light source is applied, via the polygon mirror, the reflecting mirrors, and the lenses, to the surfaces of the photoconductors 11*a* to 11*d* from downstream of the charging devices 13*a* to 13*d* in the direction of rotation of the photoconductors. The laser light thus applied causes electrostatic latent images to be formed on the respective surfaces of the photoconductors 11*a* to 11*d* and the electrostatic latent images are developed into toner images by the associated developing devices 2*a* to 2*d*.

An endless intermediate transfer belt 17 is mounted around a tension roller 6, a drive roller 25, and a driven roller 27. The drive roller 25 is driven into rotation by an unshown motor and the intermediate transfer belt 17 is driven to cycle by the rotation of the drive roller 25.

The photoconductors 11*a* to 11*d* are arranged under and in contact with the intermediate transfer belt 17 to lie next to each other along a direction of conveyance (the direction of the arrow in FIG. 1). Primary transfer rollers 26*a* to 26*d* each having a shaft and a roll face the associated photoconductors 11*a* to 11*d*, respectively, with the intermediate transfer belt 17 in between and are pressed against the intermediate transfer belt 17 to thus form a primary transfer section. In the primary transfer section, the primary transfer rollers 26*a* to 26*d* to which a transfer bias has been applied cause the respective toner images on the photoconductors 11*a* to 11*d* to be sequentially transferred to the intermediate transfer belt 17 at their respective predetermined timings with the rotation of the intermediate transfer belt 17. Thus, the toner images of four colors including magenta, cyan, yellow, and black are superimposed on the surface of the intermediate transfer belt 17 to form a single toner image thereon.

A secondary transfer roller 34 faces the drive roller 25 with the intermediate transfer belt 17 in between and is pressed against the intermediate transfer belt 17 to thus form a secondary transfer section. In the secondary transfer section, the secondary transfer roller 34 to which a transfer bias has been applied causes the toner image on the surface of the intermediate transfer belt 17 to be transferred to a paper sheet P. After the transfer, a belt cleaning device 31 cleans residual toner on the intermediate transfer belt 17.

A paper feed cassette 32 capable of containing paper sheets P is disposed in a lower portion of the interior of the image forming apparatus 1. A stack tray 35 is disposed to the right of the paper feed cassette 32 and configured to supply manually fed paper sheets. A first paper conveyance path 33 is disposed to the left of the paper feed cassette 32 and configured to convey a paper sheet P taken from the paper feed cassette 32 to the secondary transfer section on the intermediate transfer belt 17. Furthermore, a second paper conveyance path 36 is disposed to the left of the stack tray 35 and configured to convey a paper sheet taken from the stack tray 35 to the secondary transfer section. A fixing section 18 and a third paper conveyance path 39 are disposed in an upper left portion of the interior of the image forming apparatus 1. The fixing section 18 performs a fixing process for the paper sheet P on which the toner image has been formed. The third paper conveyance path 39 conveys the paper sheet P subjected to the fixing process to a paper output section 37.

The paper feed cassette 32 is configured to allow paper sheets P to be reloaded therein by pulling it out to the outside of the apparatus (toward the front side of the paper plane of FIG. 1). The paper sheets P contained therein can be fed out one by one to the first paper conveyance path 33 by a pickup roller 33*b* and a handling roller 33*a*.

The first paper conveyance path 33 and the second paper conveyance path 36 join together before a registration roller pair 33*c*. The registration roller pair 33*c* conveys the paper sheet P to the second transfer section in synchronization of the timing of an image forming operation on the intermediate transfer belt 17 with that of a paper feed operation. The paper sheet P conveyed to the secondary transfer section is subjected to secondary transfer of the toner image on the intermediate transfer belt 17 by the secondary transfer roller 34 to which a transfer bias has been applied, and then conveyed to the fixing section 18.

The fixing section 18 includes a fixing belt configured to be heated by a heater or the like, a fixing roller in contact with the inner surface of the fixing belt, a pressure roller disposed facing and pressed against the fixing roller with the fixing belt in between, and so on. The fixing section 18 performs a fixing process by heating and pressing the paper sheet P to which the toner image has been transferred. After the toner image is fixed in the fixing section 18, the paper sheet P, if necessary, is reversed by a fourth paper conveyance path 40, subjected to secondary transfer of a toner image on the other side of the paper sheet by the secondary transfer roller 34, and subjected to a fixing process in the fixing section 18. The paper sheet on which the toner image has been fixed passes through the third paper conveyance path 39 and is then output to the paper output section 37 by an output roller pair 19*a*.

Figure 2:
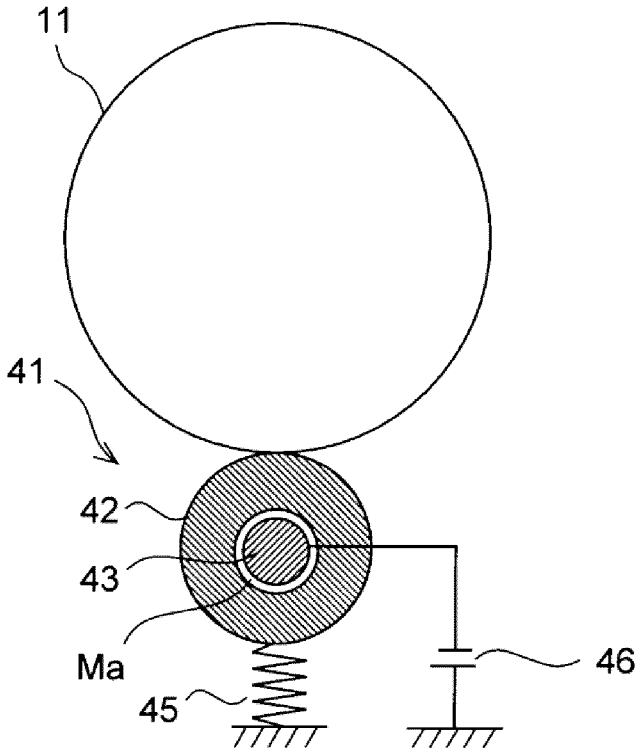
FIG. 2 is a cross-sectional view showing a charging member for use in the image forming apparatus.
Figure 3:
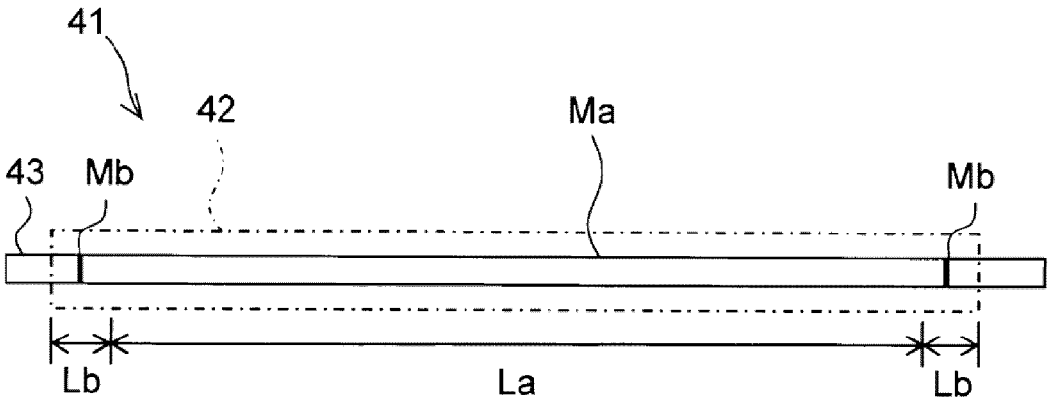
FIG. 3 is a plan view showing the charging member for use in the image forming apparatus.

FIGS. 2 and 3 are views showing the structure of a charging device for use in the above image forming apparatus 1, wherein FIG. 2 is a cross-sectional view of the charging device and FIG. 3 is a plan view thereof. The following description is given of the structure and operation of the charging device 13*a* associated with the photoconductor 11*a* shown in FIG. 1. The structures and operations of the charging devices 13*b* to 13*d* are the same as those of the charging device 13*a* and, therefore, the explanation thereof is omitted. Furthermore, letters a to d representing the individual charging devices and photoconductors for different colors are also omitted and, if necessary, these individual components are described with the letters a to d annexed to the reference numerals.

As shown in FIG. 2, the charging device 13 employs a contact charging system in which a charging member 41 serving as the charge applying member is held in contact with the surface of the photoconductor 11 serving as the member to be charged to charge the photoconductor 11.

The charging member 41 includes a conductive roller 42 held in contact with the surface of the photoconductor 11 and configured to apply an electric charge to the photoconductor 11, a shaft 43 inserted into and integrated with the conductive roller 42, and plated regions Ma covering the surface of the shaft 43.

The conductive roller 42 is made of an elastic material, such as Hydrin rubber containing a chlorine-based additive, pressed against the photoconductor 11 by an urging member 45, such as a compression coil spring, and formed of a rubber roller having a superior electric conductivity of $10^7$ Ωcm or less. Therefore, the conductive roller 42 is driven into rotation with the rotation of the photoconductor 11 and given a predetermined voltage from a power supply 46 to be described later through the shaft 43 to charge the photoconductor 11 over the entire circumference.

The shaft 43 is made of an electrically conductive material, for example, an iron material which is likely to rust but relatively inexpensive, such as SUM, and supplied with electricity from one axial end by the power supply 46. Furthermore, the shaft 43 is fixedly press-fitted into a hollow part of the conductive roller 42 to form an integral structure with the conductive roller 42. A voltage is applied through the shaft 43 to the conductive roller 42, so that the surface of the photoconductor 11 in contact with the conductive roller 42 is charged. Although the conductive roller 42 and the shaft 43 may be integrally fixed to each other in the above manner, they may be bonded together by an electrically conductive adhesive.

The plated regions Ma are regions plated with a metal having a lower ionization tendency than the shaft 43 and thus prevent corrosion of the shaft 43. For example, if the shaft 43 is made of an iron material, such as SUM, the plated regions Ma are regions plated with a lower ionization tendency than iron, such as electroless nickel, silver, copper or tin. In view of the prevention of corrosion of the shaft 43, the electric conductivity of the plated regions Ma, and the cost of the plating material, nickel plating is superior. Therefore, the plated region Ma is preferably regions plated with nickel.

As shown in FIG. 3, the surface of the shaft 43 is plated. Specifically, the conductive roller 42 is fixed on the shaft 43, unshown bearings are disposed at both ends of the conductive roller 42, and a connecting conductor (not shown) from the power supply 46 (see FIG. 2) is disposed in contact with one end of the shaft 43. The conductive roller 42 includes: a first region La facing an image forming region of the photoconductor 11 (see FIG. 2) for forming an image; and second regions Lb disposed next to both longitudinal ends of the first region La and facing regions of the photoconductor 11 located outside the image forming region. Furthermore, the plated regions Ma are formed on surface portions of the shaft 43 corresponding to the first region La and the second regions Lb, sliding portions of the shaft 43 with the bearings, and a portion of the shaft 43 connected to the power supply 46.

On the other hand, non-plated regions Mb are formed on part of the surface portions of the shaft 43 corresponding to the second regions Lb. Each non-plated region Mb is formed, over the entire circumference of the shaft 43, with a relatively small width in the axial direction of the shaft 43, such as 0.5 mm. In the non-plated regions Mb, the surface of the shaft 43 (i.e., the bare surface of the shaft material) faces the surface of the conductive roller 42 fixed on the shaft 43.

With the above structure, if the humidity inside the image forming apparatus 1 is increased or the charging member 41 is exposed to high humidity for long periods, so that water penetrates the conductive roller 42 to make the surface of the shaft 43 susceptible to rust, rust will form concentrically on the non-plated regions Mb formed on the portions of the shaft 43 corresponding to the second regions Lb and form less on the portion of the shaft 43 corresponding to the first region La. Therefore, the first region La facing the image forming region of the photoconductor 11 is not affected by rust, so that the conductive roller 42 can be uniformly given a voltage from the power supply 46 through the shaft 43 and the image forming region of the photoconductor 11 can be uniformly charged.

For example, in the technique for reducing charging failure due to rusting by applying a rust inhibitor to the portions of the shaft facing both ends of the conductive roller, rust will form on the surface portion of the shaft in contact with the conductive roller but may not necessarily form evenly on it. Therefore, rusted sites on the shaft show large electric resistance owing to the rust and the electric resistance varies between the rusted sites and non-rusted sites on the shaft. Thus, an electric charge given from the charging member to the photoconductor becomes unsteady to make it difficult to uniformly charge the photoconductor.

In contrast, in the embodiment given by the present disclosure, rust is concentrated on the non-plated regions Mb formed on part of the shaft portions corresponding to the second regions Lb, so that the shaft portion corresponding to the first region La is less rusted. Therefore, even if rust forms on the non-plated regions Mb facing the regions of the photoconductor outside the image forming region, it is less likely that the portion of the shaft 43 facing the image forming region of the photoconductor 11 will cause variations in electric resistance owing to the presence of rusted sites and non-rusted sites. Thus, even in an environment likely to cause the shaft 43 to get rusted, charging failure of the photoconductor 11 due to rusting of the shaft 43 can be reduced, so that the image forming region of the photoconductor 11 can be uniformly charged.

The plating process, inclusive of the non-plated regions Mb, is implemented by applying a liquid plating masking agent (subjecting a masking treatment) to the portions of the shaft 43 corresponding to the non-plated regions Mb and then immersing the shaft 43 into a plating bath. Alternatively, the non-plated regions Mb may be formed by first plating the entire shaft 43 and then stripping the plating on predetermined surface portions of the shaft 43 with a scriber or the like. Instead of providing the non-plated regions Mb at the portions of the shaft 43 corresponding to both the second regions Lb, a single non-plated region Mb may be provided to correspond to one of the second regions Lb. Furthermore, instead of providing the non-plated region Mb over the entire circumference of the shaft 43, the non-plated region Mb may be formed on part of the circumference of the shaft 43, such as a half the circumference.

In the above embodiment, an example has been described in which the member to be charged is applied to the photoconductor 11 and the charge applying member is applied to the charging member 41. However, the present disclosure is not limited to this combination. For example, in FIG. 1, the charge applying member may be the primary transfer roller 26 (transfer roller) pressed against the photoconductor 11 with the intermediate transfer belt 17 in between and configured to transfer a toner image carried on the photoconductor 11 to the intermediate transfer belt 17 by the application of a voltage and the member to be charged may be the intermediate transfer belt 17. In this case, the formation of rust on the shaft portion corresponding to the first region La of the primary transfer roller 26 facing the image forming region of the intermediate transfer belt 17 is reduced, so that the roll of the primary transfer roller 26 can be uniformly given a voltage from the power supply through the shaft and the image forming region of the intermediate transfer belt 17 can be uniformly charged.

Figure 4:
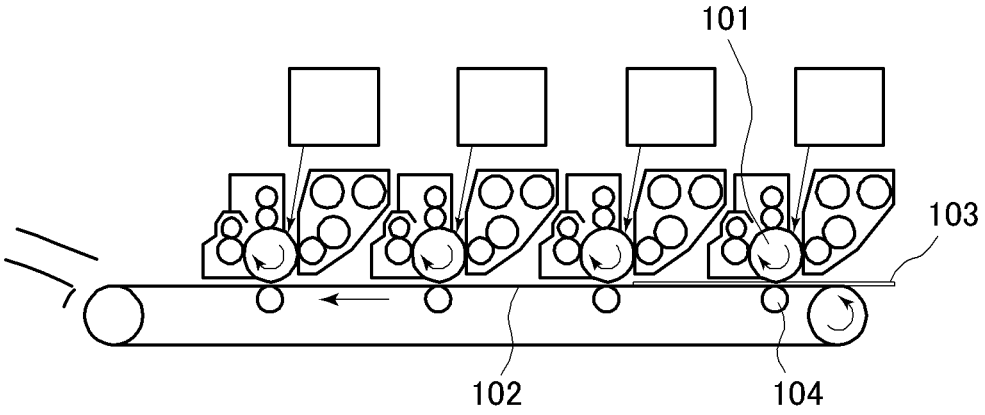
FIG. 4 is a view schematically showing a transfer roller pressed against a photoconductor with a conveying belt.
Figure 5:
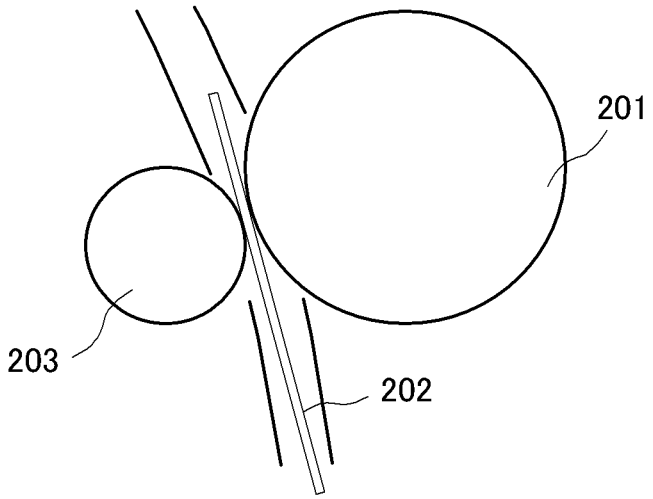
FIG. 5 is a cross-sectional view showing a transfer roller pressed against a photoconductor and a paper sheet.

Alternatively, the charge applying member may be the secondary transfer roller 34 (transfer roller) configured to transfer a toner image carried on the intermediate transfer belt 17 to a paper sheet P serving as a recording medium by the application of a voltage. Still alternatively, shown in FIG. 4, the charge applying member may be a transfer roller 104 pressed against a photoconductor 101 with a conveying belt 102 carrying a paper sheet 103 in between and configured to transfer a toner image formed on the photoconductor 101 to the paper sheet 103 on the conveying belt 102 by the application of a voltage. Still alternatively, shown in FIG. 5, the charge applying member may be a transfer roller 203 pressed against a photoconductor 201 to form a nip therebetween and configured to transfer a toner image carried on the photoconductor 201 to a paper sheet 202 conveyed to the nip by the application of a voltage. Also in these cases, the same effects as in the above embodiment can be performed.

EXAMPLES

The following is a description of Examples 1 and 2 in which the details of the embodiment as one aspect of the present disclosure are specified and Comparative Examples 1 and 2. However, the present disclosure is not limited to the following examples only.

Test 1 and Test 2 were conducted using Examples 1 and 2 in which non-plated regions Mb were provided on the shaft 43 of the charging member 41 and Comparative Examples 1 and 2 in which no non-plated regions Mb were provided on the shaft 43. Test 1 was conducted to evaluate the number of rusted sites formed on the shaft 43 and Test 2 was conducted to evaluate the number of rusted sites formed on the shaft 43 and the quality of the resultant image.

The conductive roller 42 of the charging member 41 used in Tests 1 and 2 was made of Hydrin rubber containing a chlorine-based additive and having an electric conductivity of $10^6$ Ωm, the shaft 43 was formed of a drawn material of SUM 22, and the surface of the shaft 43 was plated with 3 to 6 μm thick electroless nickel.

The charging member 41 used in Example 1 and Comparative Example 1 for Test 1 was one in which the conductive roller 42 and the shaft 43 were integrally fixed to each other. On the other hand, the charging member 41 used in Example 2 and Comparative Example 2 for Test 1 was one in which the conductive roller 42 and the shaft 43 were bonded together by a hydrophobic adhesive. In Examples 1 and 2, 0.5 mm wide, full-circumference non-plated regions Mb were formed on surface portions of the shaft 43 corresponding to the second regions Lb located at both ends of the conductive roller 42. In Comparative Examples 1 and 2, no non-plated region Mb was formed.

In Test 1, each of the above charging members 41 was immersed into 4% brine for three hours, the conductive roller 42 was then removed from the charging member 41, and the number of rusted sites on the surface portion of the shaft 43 corresponding to the first region La was visually measured. The results are shown in TABLE 1.

TABLE 1

| | Number of Rusted Sites |
|---|---|
| Example 1 | 0 |
| Example 2 | 0 |
| Comparative Example 1 | 14 |
| Comparative Example 2 | 8 |

As shown in TABLE 1, in Comparative Examples 1 and 2, a large number of rusted sites were formed on the surface portion of the shaft 43 corresponding to the first region La. In Examples 1 and 2, rust formed on the non-plated regions Mb but no rust formed on the surface portion of the shaft 43 corresponding to the first region La, resulting in good results.

Also for Test 2, like Test 1, the charging member 41 used in Example 1 and Comparative Example 1 was one in which the conductive roller 42 and the shaft 43 were integrally fixed to each other, and the charging member 41 used in Example 2 and Comparative Example 2 was one in which the conductive roller 42 and the shaft 43 were bonded together by a hydrophobic adhesive. In Examples 1 and 2, 0.5 mm wide, full-circumference non-plated regions Mb were formed on surface portions of the shaft 43 corresponding to the second regions Lb. On the other hand, in Comparative Examples 1 and 2, no non-plated region Mb was formed.

In Test 2, each of the above charging members 41 was allowed to stand in a hot and humid environment of 50° C. and 90% humidity for 14 hours, then subjected to electric conduction with 1000V AC voltage at 10 kHz for 7 days, then assembled in the image forming apparatus 1, and evaluated for the quality of the resultant image. After the image quality evaluation, the conductive roller 42 was removed from the charging member 41 and the number of rusted sites on the surface portion of the shaft 43 corresponding to the first region La was visually measured. The results are shown in TABLE 2.

TABLE 2

| | Number of Rusted Sites | Image Quality |
|---|---|---|
| Example 1 | 0 | good |
| Example 2 | 0 | good |
| Comparative Example 1 | 5 | no good |
| Comparative Example 2 | 8 | no good |

As shown in TABLE 2, in Comparative Examples 1 and 2, rust formed on the surface portion of the shaft 43 corresponding to the first region La. In Examples 1 and 2, rust formed on the non-plated regions Mb but no rust formed on the surface portion of the shaft 43 corresponding to the first region La, resulting in good results. Furthermore, in Comparative Examples 1 and 2, rust on the surface portion corresponding to the first region La caused uneven electric resistivity on the charging member 41 and thus nonuniform charging of the photoconductor 11, resulting in repetitive pattern-like image failure on a gray background. In Examples 1 and 2, good images were obtained.

The charge applying member according to the embodiment as one aspect of the present disclosure is applicable to a charge applying member configured to apply an electric charge to a member to be charged for use in an image forming apparatus, such as a copier, a printer, a facsimile machine, or a multifunction peripheral having these functions.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A charge applying member configured to apply an electric charge to a member to be charged for use in an image forming apparatus which is configured to develop an electrostatic latent image into a toner image and transfer the toner image to a transfer member, the charge applying member comprising:

a conductive roller which includes a first region held in contact with the member to be charged and facing an image forming region of the member to be charged and a second region disposed next to a longitudinal end of the first region and facing a region of the member to be charged located outside the image forming region and is configured to apply an electric charge to the member to be charged; and a shaft which is formed of a metallic material inserted into the conductive roller and is configured to be given a voltage from a power supply, wherein the conductive roller is fixed on the shaft, and a region plated with a metal having a lower ionization tendency than the shaft is formed as a plated region on a portion of an outer periphery of the shaft corresponding to the first and second regions and a non-plated region is formed on a part of a portion of the outer periphery of the shaft corresponding to the second region fixed to the conductive roller.

2. The charge applying member according to claim 1, wherein the non-plated region is formed with a predetermined width over the entire circumference of the shaft.

3. The charge applying member according to claim 1, wherein the non-plated region is formed by masking a portion of the shaft corresponding to the non-plated region and then plating the shaft by immersing the shaft into a plating bath.

4. The charge applying member according to claim 1, wherein the non-plated region is formed by plating the entire surface of the shaft and then partly stripping the plating on the shaft.

5. The charge applying member according to claim 1, wherein the roller is made of a rubber material, the shaft is made of an iron material, and the plated region is a region plated with nickel.

6. The charge applying member according to claim 1, wherein the member to be charged is a photoconductor capable of carrying the electrostatic latent image, and the charge applying member is a charging member pressed against a surface of the photoconductor and configured to charge the photoconductor.

7. The charge applying member according to claim 1, wherein the charge applying member is a primary transfer roller configured to transfer the toner image carried on a photoconductor to an intermediate transfer belt as the transfer member.

8. The charge applying member according to claim 1, wherein the charge applying member is a secondary transfer roller configured to transfer the toner image carried on an intermediate transfer belt as the member to be charged to a recording medium as the transfer member.

9. The charge applying member according to claim 1, wherein the charge applying member is a transfer roller pressed against a photoconductor as the member to be charged to form a nip therebetween and configured to transfer the toner image carried on the photoconductor to a recording medium as the transfer member conveyed to the nip.

10. An image forming apparatus including the charge applying member according to claim 1.

11. The charge applying member according to claim 1, wherein the charge applying member is a transfer roller configured to transfer the toner image carried on a photoconductor to a recording medium as the transfer member carried by a conveying belt as the member to be charged.

* * * * *